US005357931A

United States Patent [19]

Semence

[11] Patent Number: 5,357,931

[45] Date of Patent: Oct. 25, 1994

[54] SUPPLY DEVICE WITH BUILT-IN PIPEWORK

[75] Inventor: Pierre Semence, Chatou, France

[73] Assignee: SOLEX, France

[21] Appl. No.: 141,081

[22] Filed: Oct. 26, 1993

[30] Foreign Application Priority Data

Oct. 26, 1992 [FR] France ..... 92 12714

[51] Int. Cl.[5] ..... F02M 55/02; F02M 35/10

[52] U.S. Cl. ..... 123/456; 123/470; 123/184.61

[58] Field of Search ..... 123/456, 468, 469, 470, 123/52 M, 52 MC, 52 MB, 585

[56] References Cited

U.S. PATENT DOCUMENTS

| | | | |
|---|---|---|---|
| 4,516,555 | 5/1985 | Shioya et al. | 123/470 |
| 4,570,602 | 2/1986 | Atkins et al. | 123/468 |
| 4,702,202 | 10/1987 | Hensel et al. | 123/52 MC |
| 4,776,313 | 10/1988 | Freismuth et al. | 123/470 |
| 4,819,588 | 4/1989 | Itoh et al. | 123/52 M |
| 4,848,280 | 7/1989 | Ohtsuka et al. | 123/52 MC |
| 4,898,125 | 2/1990 | Ampferer | 123/52 MC |
| 4,970,994 | 11/1990 | Sawada et al. | 123/52 MV |
| 5,003,933 | 4/1991 | Rush, II et al. | 123/52 MC |
| 5,074,269 | 12/1991 | Herbon et al. | 123/470 |
| 5,156,124 | 10/1992 | Sugimoto et al. | 123/470 |
| 5,163,406 | 11/1992 | Daly et al. | 123/456 |

FOREIGN PATENT DOCUMENTS

| | | |
|---|---|---|
| 0294083 | 12/1988 | European Pat. Off. . |
| 2234780 | 2/1991 | United Kingdom . |

*Primary Examiner*—E. Rollins Cross
*Assistant Examiner*—Thomas N. Moulis
*Attorney, Agent, or Firm*—Larson and Taylor

[57] ABSTRACT

The supply device with built-in pipework comprises an air distributor/manifold module with a casing and a base element made from plastic or metal and which are fixed to one another. The base element has pipework branches emerging in the casing and in a flange for fixing on to the engine. The casing houses sensors and members for controlling operating parameters of the engine as well as a fuel rail and its regulator supplying injectors which are trapped between the base element and the casing. Components of the air, fuel, ignition and electrical supply circuits are built into the pipework.

14 Claims, 8 Drawing Sheets

Figure 2:
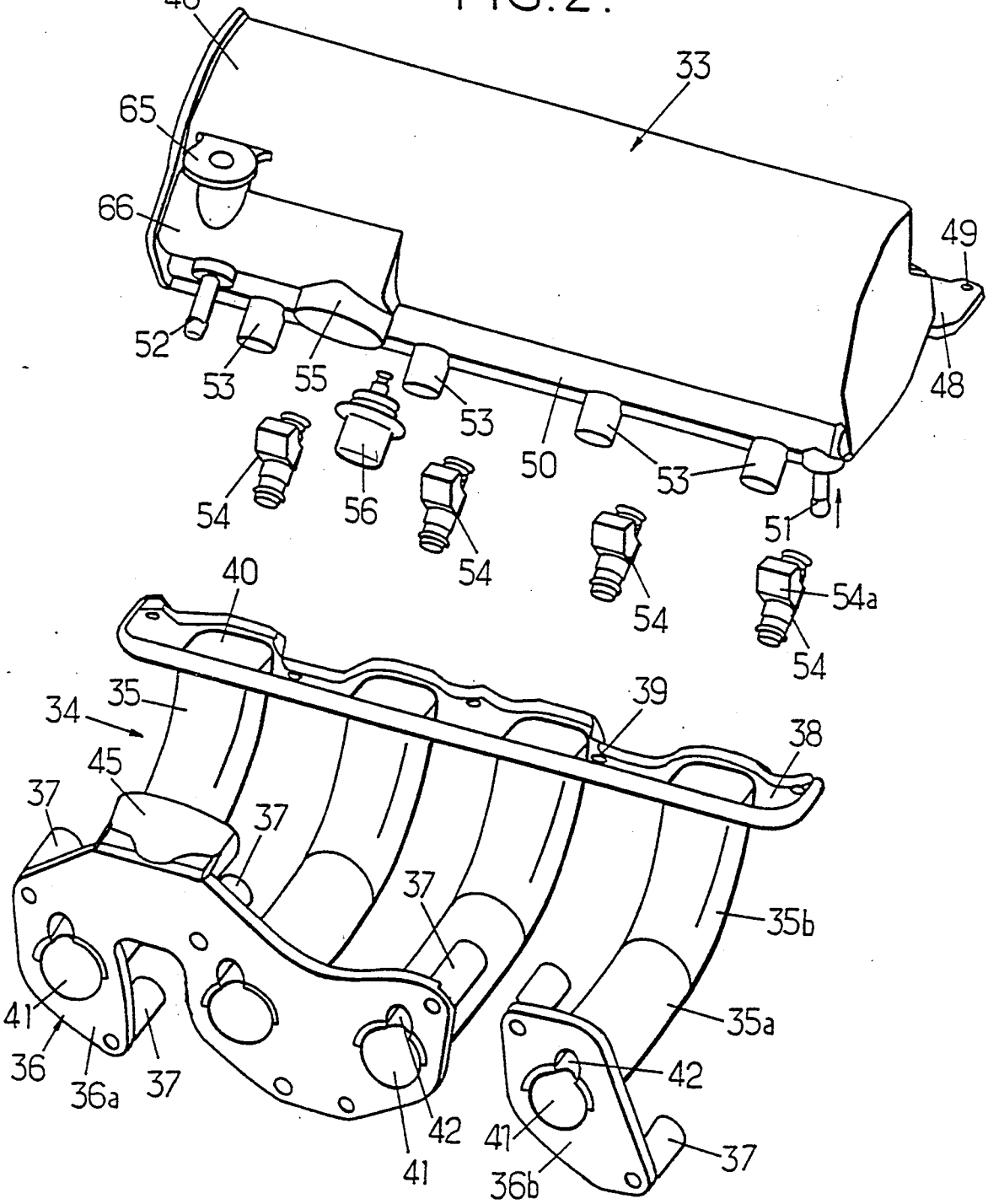

FIG.1.
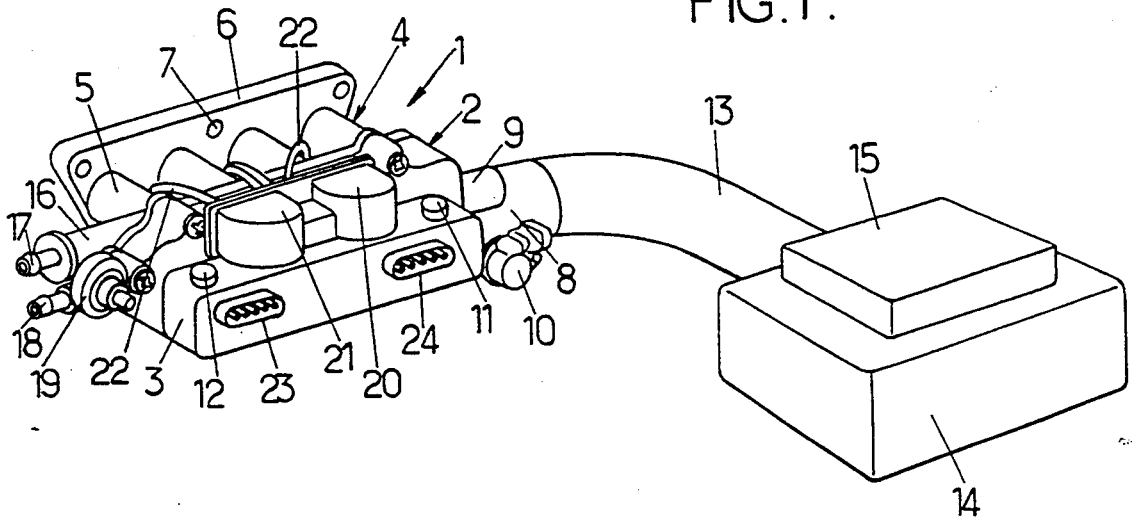
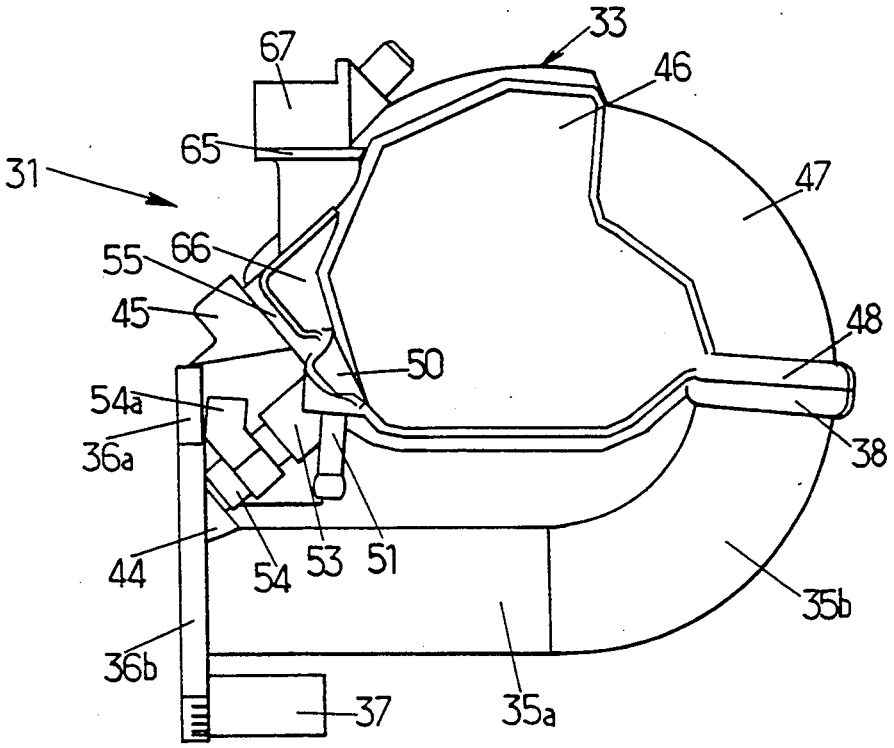
FIG.6.

SUPPLY DEVICE WITH BUILT-IN PIPEWORK

The invention relates to a supply device with built-in pipework, for a system supplying an internal combustion engine with fuel by injection, of the multi-point type, that is to say for a supply system comprising, for each cylinder of the engine, at least one electrically controlled injector delivering pressurized fuel into a corresponding branch of pipework for intake to the engine, emerging in the cylinder head of the engine facing the intake orifice or orifices of the corresponding cylinder and/or the stem of the corresponding intake valve or valves, the injection of fuel into the branch of pipework taking place, on the one hand, downstream of a butterfly body, in which at least one restriction member, termed a butterfly and mounted so that it can pivot on a spindle in a pipe passing through the butterfly body, is controlled in terms of position directly or indirectly via the accelerator pedal and, on the other hand, directly upstream of the corresponding intake valve or valves, generally in the vicinity of the coupling of this pipework branch to the cylinder head of the engine.

European Patent Application EP 294,883 already discloses a supply device with built-in pipework for a multipoint injection system and of the type comprising an air intake distributor/manifold module including two moulded plastic components fixed to one another, and one of which is a pipework casing having an air supply orifice, on which is arranged a butterfly body, and air outlet openings, formed in a flange for joining to the other component, which is a base element having at least as many pipework branches as the engine has cylinders, and a flange for joining to the casing, which flange is fixed to the flange of the casing with interposition of a sealing gasket, and in which each branch opens out at one of its ends via an inlet opening, corresponding to one, respectively, of the outlet openings from the casing, to emerge in the latter, the pipework branches being secured via their other end to at least one fixing flange of the base element, which flange is equipped with means for fixing the built-in pipework on to the cylinder head of the engine, the pipework casing being designed so that it supports and/or encloses, at least partially, at least one sensor and/or at least one member for controlling an operating parameter of the engine and, for each cylinder of the engine, each corresponding injector being arranged between the casing and the base element of the module.

Such a supply device facilitates the mounting on the engine of numerous components of the multipoint injection system, and not only components such as sensors and/or driving members for various operating parameters of the engine relating to the air supply circuit, but also similar components of the associated circuits for supplying fuel and for electrically supplying the injectors, as well as of the electrical ignition circuit, whilst decreasing the overall size of the system, simplifying the couplings and connections of these components, and reducing the number and significance of the points and means for fixing these components to the engine.

In particular, the circuit for supplying the injectors with fuel is partially built into the pipework. This circuit comprises an elongate case, made as a single component with the base element, and secured to the flange for fixing the built-in pipework on to the cylinder head, this case being traversed by a passage for supplying fuel, which emerges in series into cups for housing the injectors, the cups being formed in the case, and each one emerging via an orifice in one corresponding pipework branch, this case also being traversed by a passage for returning the excess fuel, which passage extends substantially parallel to the supply passage without emerging into the cups for housing the injectors, the supply and return passages being coupled to one another by a device for regulating the pressure of the fuel supplied to the injectors, arranged at the end of the case, on the side opposite the respective couplings of the passages for supplying the fuel and returning it to tank.

The drawback of such a supply device with built-in pipework is that the structure of the built-in circuit for supplying the injectors with fuel, supplying them in series and from the side, allows only the use of injectors of the type termed "side feed injectors", and that this structure is not suited to receiving and to mounting injectors of the type termed "top feed injectors", nor to the mounting of injectors of the type termed aerated or ventilated injectors, (receiving, simultaneously with the supply of fuel, a supply of additional air at atmospheric pressure, coming from downstream of the air filter), having a markedly better performance.

The problem at the root of the invention is to overcome this drawback in supply devices of the type known from EP 294,883, and the object of the invention is to propose a supply device with built-in pipework for a multipoint injection system which allows injectors of the top feed type as well as, in a preferred embodiment, aerated or ventilated injectors to be mounted.

A further object of the invention is to propose a supply device with built-in pipework for such a system which can be offered to car manufacturers in the form of an assembly which is as complete as possible, prechecked and, possibly, preset, capable of being mounted directly on the engine, and which is easy to couple to the parts of the air, fuel and electric circuits which are not built into the pipework, so as to reduce assembly time and improve quality.

To this end, the subject of the invention is a supply device with built-in pipework, of the type described hereinabove, known from EP 294,883, and which is characterized in that a fuel distribution rail is built into the casing which has, at each of the two ends of the rail, a tubular fitting for coupling the rail to a fuel supply pipe from a tank and to a pipe for returning the fuel to tank respectively, the casing having, between the two ends of the rail, and for each injector, at least one orifice in communication with the inside of the rail, for supplying the corresponding injector with fuel.

Building the fuel supply rail into the casing makes it possible to supply the injectors in parallel and from the top, so that the mounting of injectors of the type termed "top feed injectors" is preferred.

In order simultaneously to facilitate the positioning of each injector of this type, and its coupling to the fuel distribution circuit, the fuel supply to each injector is provided in a sleeve, projecting from the casing, on the side turned towards at least one flange for fixing on to the cylinder head, and in which the corresponding injector is at least partially housed with a sealing gasket.

In addition, and for the same reasons, it is advantageous that, for each injector, the flange for fixing the base element has, on the side turned towards the casing, a housing for receiving an injector, emerging in the corresponding pipework branch and in which the corresponding injector is at least partially housed with a sealing gasket.

If the injection system is intended to be equipped with aerated or ventilated injectors, the supply device according to the invention is advantageously such that an additional air supply line is built into the base element, substantially at the junction of the pipework branches and of a flange for fixing the base element on to the cylinder head and has, on the one hand, at one of its ends, a tubular coupling fitting for the supply of additional air taken from the air filter, downstream of the actual filter and, on the other hand, for each injector, at least one orifice placing the inside of the additional air supply line in communication with the inside of a housing for receiving the injector, formed in the flange and/or the additional air supply line on the side turned towards the casing, and emerging in the corresponding pipework branch, so as to house, at least partially, an injector of the ventilated type which is supplied simultaneously with fuel and with air.

Furthermore, and also preferably, the device for regulating the pressure of the fuel supplied to the injectors is also trapped between the casing and the base element of the module. Thus, protection is afforded not only to the injectors but also to the fuel pressure regulator owing to the fact that they are mounted between the base element and the casing of the built-in pipework.

In order to ensure correct positioning of the pressure regulator, between the casing and the base element of the air intake distributor/manifold module, as well as good operational interaction with these two parts, it is additionally advantageous for at least one flange for fixing the base element on to the cylinder head to have, on the side turned towards the casing, a dish for receiving the pressure regulator, interacting with a sleeve for housing the said regulator, projecting from the casing, on the side turned towards the said fixing flange and in communication with the fuel rail so that, when the regulator is housed in the sleeve and in the dish, and when the base element is fixed on to the casing, the regulator is in equilibrium between, on the one hand, the fuel pressure in the rail, which it receives via a regulator part which is engaged in a sealed manner in the said sleeve and, on the other hand, the pressure of the air in the module, which it receives via a regulator part which is engaged in the said dish, the inside of which is connected in a sealed manner, in the interaction position of the sleeve and of the dish, with a passage formed in the said sleeve and emerging in the casing. The supply device pipework thus produced advantageously incorporates the majority of the components of the air and fuel supply circuits of the injection system.

However, it is furthermore advantageous for at least some components of the high-power electrical circuit, comprising the ignition coils, and the low-power circuit, comprising various sensors and actuators, also to be built into the pipework of the supply device. To this end, the casing advantageously has at least one electrical connector, mounted in a sealed manner in a corresponding housing of the casing, and providing the connection with at least one component carried in and/or on the module, such as an ignition coil.

The sealing of the mounting of each connector on the casing is, for example, obtained by over moulding the latter around the connector, because the casing and the base element of the distributor/manifold module of the pipework are advantageously two components moulded from plastic and fixed to one another without further machining.

An excellent incorporation of the components of the four air, fuel, electric, and ignition supply circuits is provided if, on and/or in the casing, housings are formed which receive at least sensors of intake air circulation parameters, such as sensors for measuring the temperature and pressure of the air in the module, at least one power component such as an electrical ignition coil, at least one low-power electrical connector, connected at least to the sensors and to the injectors, and at least one high-power electrical connector, connected at least to the power component.

Finally, advantageously, at least one bundle of electrical conductors, preferably built into the plastic casing, provides the coupling to electrical earth of each component incorporated into and/or on to the distributor/ manifold module.

In order to decrease the overhang of the built-in pipework fixed to the cylinder head of the engine, to give better mechanical behaviour and raise the resonance frequency of the assembly mounted on the engine, it is advantageous for at least some of the components built into the pipework to be mounted in and/or on a part of the module which is located on the side of the flange or flanges for fixing on to the cylinder head, and for the casing and the base element of the module to have a configuration such that the distance separating the centre of gravity of the built-in pipework from the plane for fixing the flange or flanges on to the cylinder head is less than the distance separating the geometric centre of the said built-in pipework from this plane for fixing the flange or flanges on to the cylinder head.

Simultaneously, to give the integrated pipework greater compactness, it is advantageous for, on the side opposite at least one flange for fixing to the cylinder head, the casing to have air outlet pipes, equal in number to the number of branches of pipework coupled to the said fixing flange, each one emerging via one end in a central chamber of the casing called a plenum chamber, and via the other end in the flange of the casing fixed to the flange of the base element, level with an outlet opening corresponding with a pipework branch, so that each pipework branch which is curved in at least an upstream part coupled to the flange of the base element fixed to the casing, extends a corresponding air pipe of the casing, which is also curved, the curved air pipes and the curved parts of the pipework branches having their concavity turned towards the said flange for fixing on to the cylinder head, so as to envelope partially the plenum chamber and the various components which are trapped between the casing and the base element and/or housed in/or on the casing.

In order further to decrease the assembly times, the air filter is preferably also built into the air intake distributor/manifold module. Likewise, the electronic control unit, or computer for controlling the supply to the engine is advantageously built into the air intake distributor/manifold module in order to cool it by circulating air in the built-in pipework. In the latter case, it is advantageous for the air filter and the computer for controlling the supply to the engine to be built into the distributor/manifold module and combined with the latter as a pre-wired sub-assembly, which makes it possible to carry out trials and checks, as well as compensation settings of the sub-assembly before mounting it on the engine, and therefore enables the constructor to improve the quality and simplify mounting.

Figure 3:
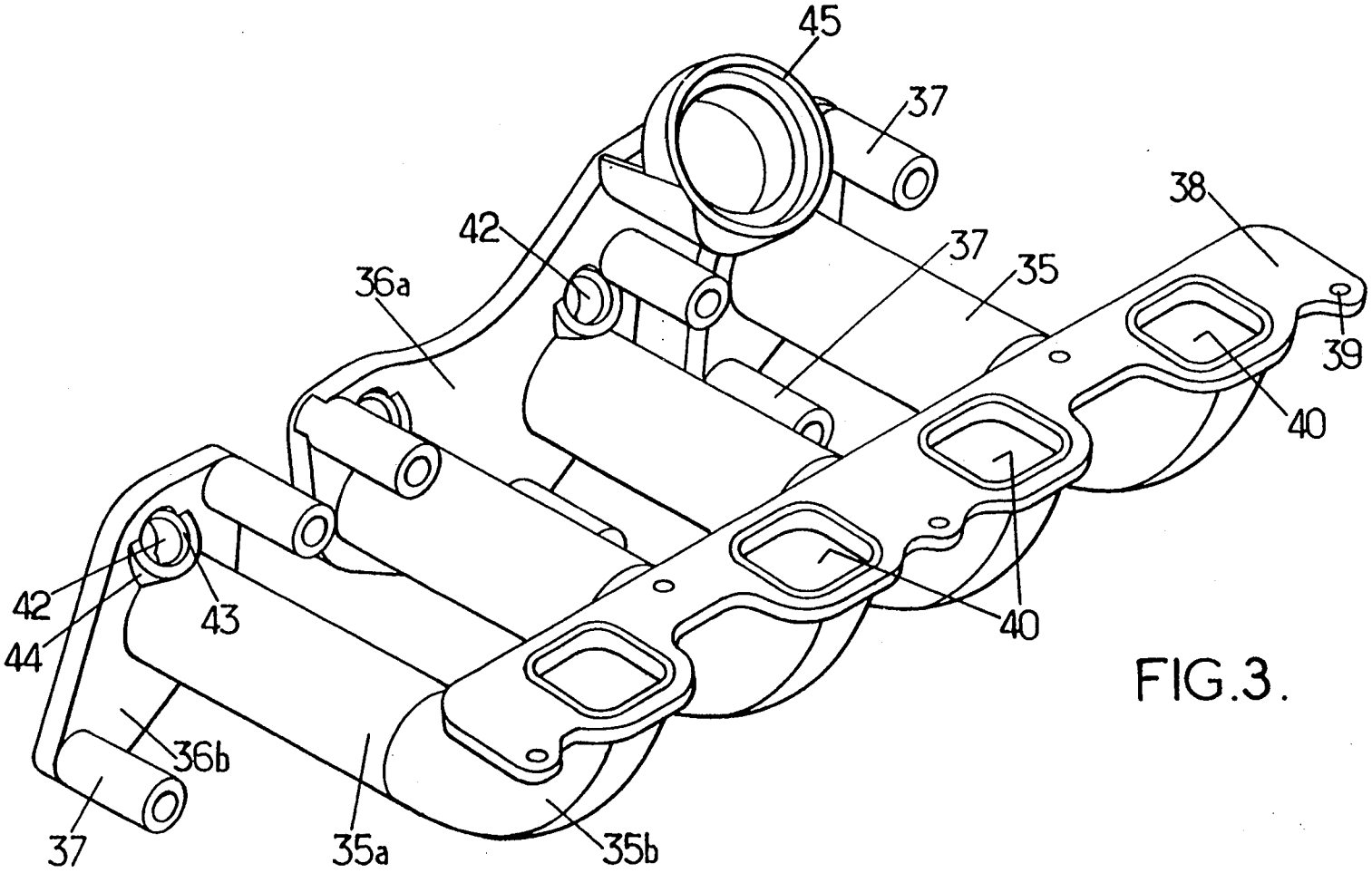
Figure 4:
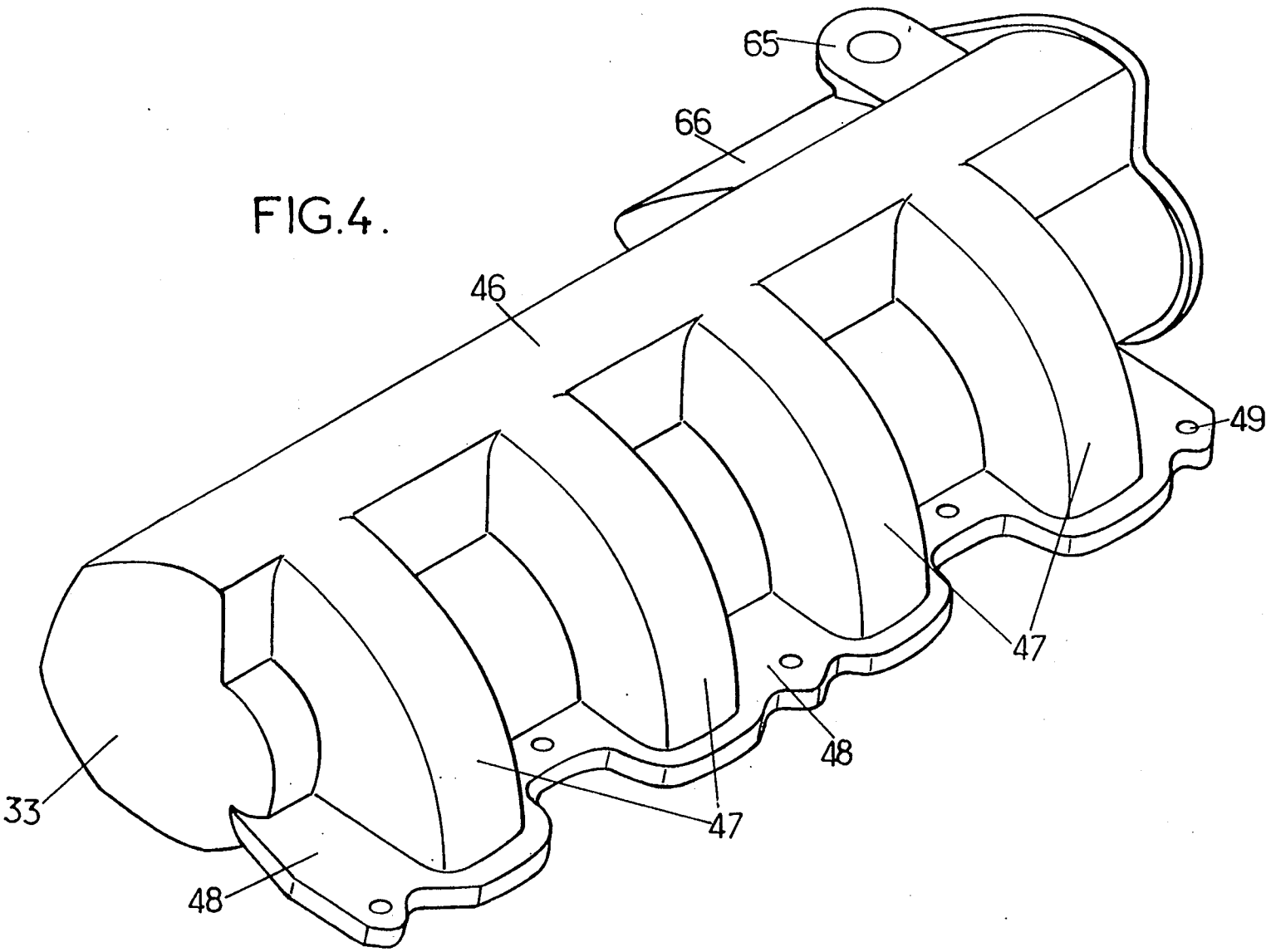
Figure 5:
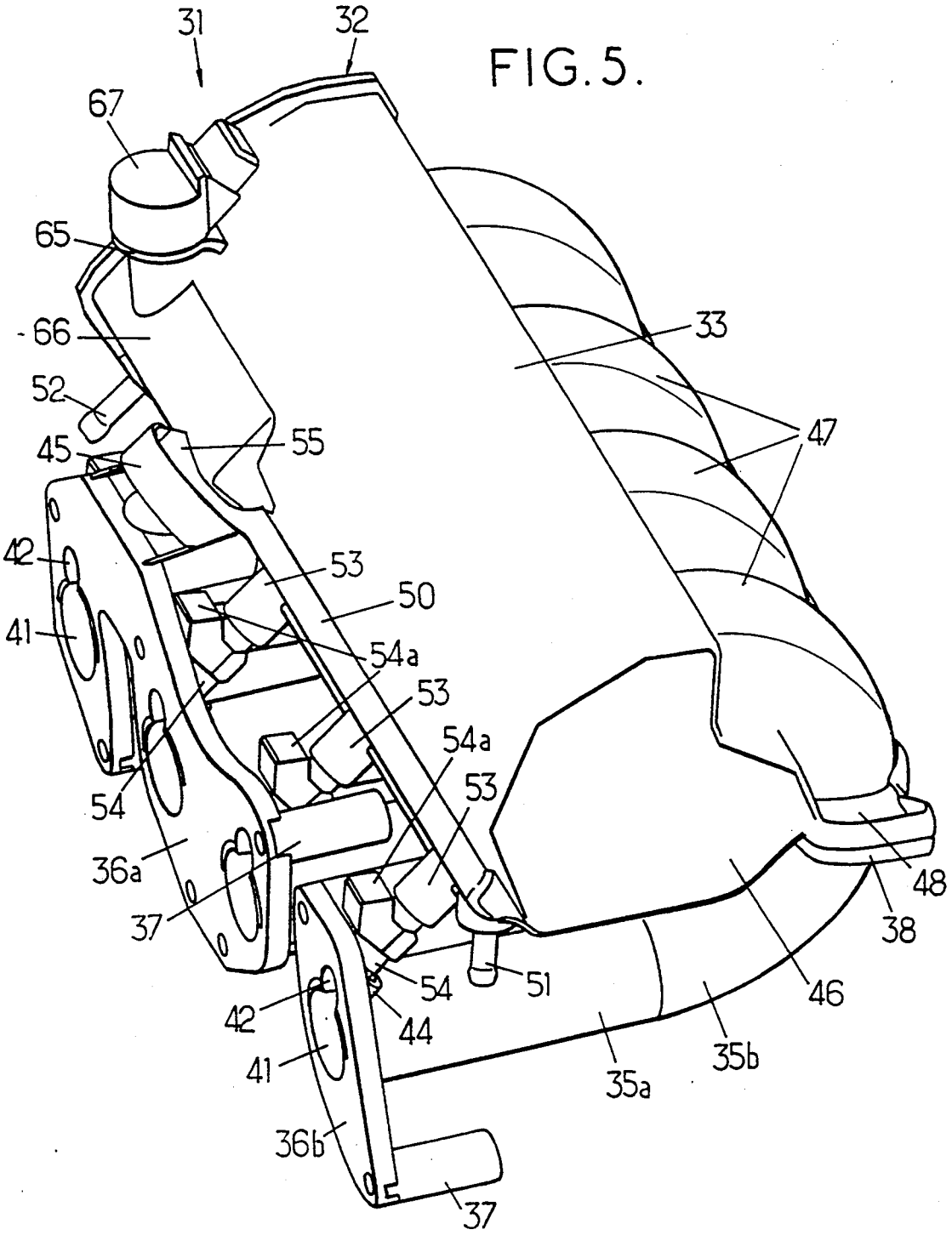
Figure 7:
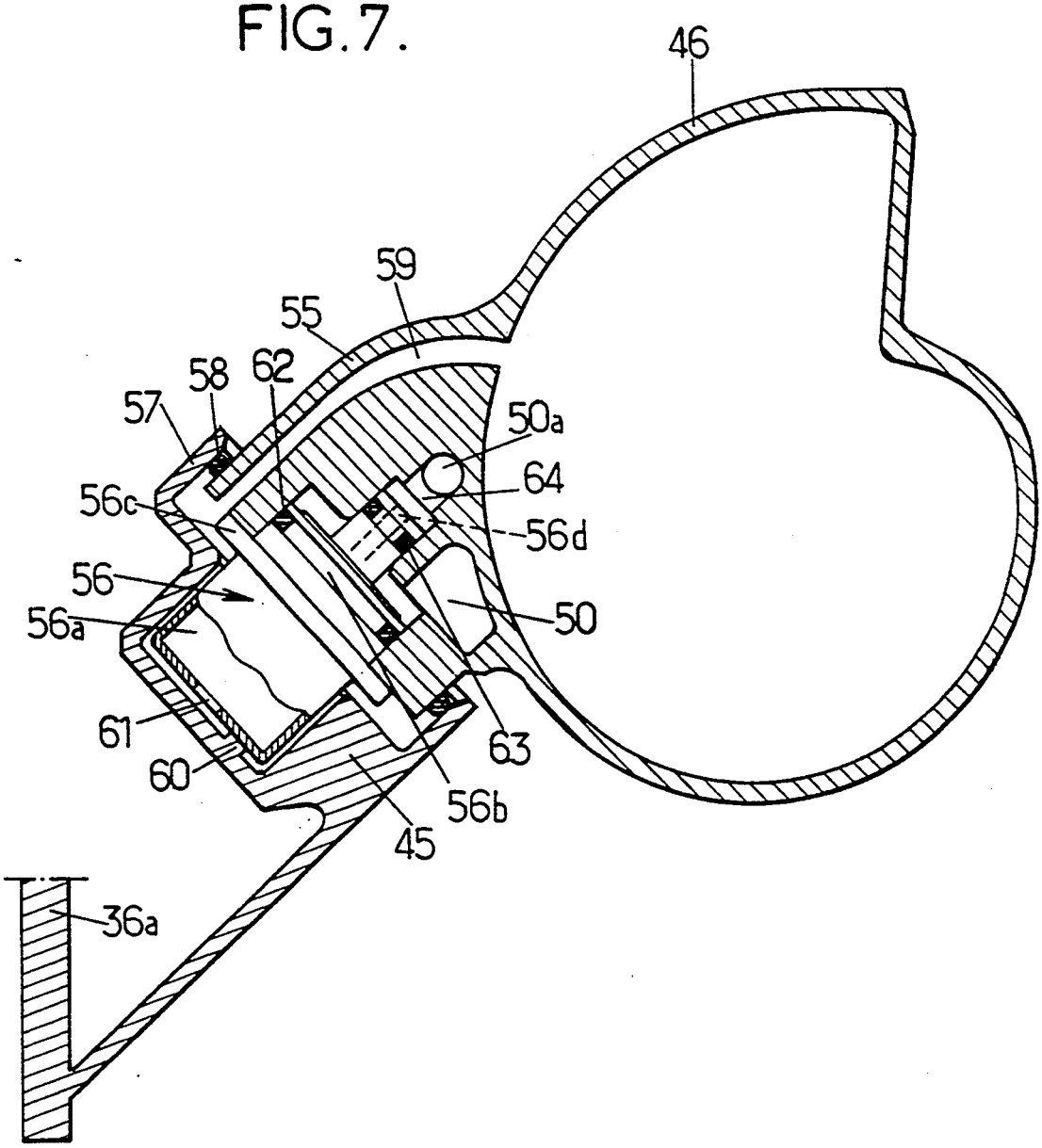

The invention will be more easily understood and other advantages and features of the invention will emerge from the description given hereafter, in a non-limiting way, of an embodiment described with reference to the appended drawings in which:

FIG. 1 represents diagrammatically and in perspective a built-in supply system comprising a first example of a supply device with built-it pipework, FIG. 2 represents, in perspective, and in an exploded view, a second example of built-in pipework for a supply device of an internal combustion engine injection system, FIGS. 3 and 4 are perspective and diagrammatic views of each of the two main components of the built-in pipework of FIG. 2, FIG. 5 is a perspective view of the built-in pipework of FIG. 2 after assembly of its two main constituent components and of the essential components of the circuit for supplying the engine with fuel, FIG. 6 is a side elevation of the built-in pipework of FIG. 5, FIG. 7 is a partial and diagrammatic view, in section, of the mounting of the pressure regulator between the casing and the base element of an integrated pipework according to FIGS. 2 to 6, and FIGS. 8 and 9 are views similar to FIGS. 3 and 6 of a variant of the built-in pipework of FIGS. 2 to 7 which is adapted for mounting ventilated injectors.

The built-in supply device of FIG. 1, for a system for supplying an in-line four-cylinder internal combustion engine with fuel by multipoint injection, comprises a built-in pipework 1 including an air intake distributor/-manifold module 2. This module 2 essentially consists of the assembly of two moulded plastic or metallic components which are used without further machining, one of which is an elongate casing 3 and the other a base element 4, which includes as many pipework branches 5 as the engine has cylinders, that is to say, four in this example. Via its end on the side opposite the casing 3, each of the branches 5 is secured to a flange 6 for fixing the pipework 1 to the cylinder head (not represented) of the engine. Each branch 5 emerges in the face of the flange 6 on the side opposite the casing 3, and the flange 6 has piercings 7 so that it can be screw-fastened on to the cylinder head, so that each branch 5 opens out into the cylinder head facing the stem of the injection valve or valves of the corresponding cylinder, when the pipework 1 is mounted on the cylinder head via its flange 6.

The base element 4 also includes a flange for joining to a flange, of conjugate shape, of the casing 3, and each branch 5 is secured via its other end to the flange of the base element, in which each branch 5 opens out via an inlet opening facing a corresponding air outlet opening formed in the flange of the casing 3. These two flanges, which are not visible in FIG. 1, are fixed by screwing against one another, to the base of the casing 3, with interposition of a sealing gasket between them so that the branches 5 thus emerge into the casing 3. The latter has, on its side, an air supply orifice, also not represented in FIG. 1, to which is coupled, in a sealed manner, a butterfly body 8 possibly with incorporated flow meter, which is supported by the casing 3 so that the outlet from the butterfly body emerges in the casing 3. An actuator 9, for example an electric stepper motor for regulating the flow of idling air or, possibly a DC electric motor or some other device for motorizing the butterfly, as well as a sensor 10 for detecting the angular position of the butterfly, such as a potentiometer, are secured to the butterfly body 8, and one and/or the other are supported directly by the latter or, as a variant, by the casing 3. The upper face of the casing 3 has, on the side of the butterfly body 8, a housing for receiving a sensor 11 for detecting the pressure of the intake air in the casing 3 and, on the opposite side, a housing for receiving a sensor 12 for detecting the temperature of the air in this casing 3.

To supplement the air supply circuit of the engine, the inlet orifice of the butterfly body 8 is coupled via a pipe 13 to the outlet from an air filter 14 on which the electronic control unit 15 of the system is installed. This unit 15, which essentially comprises a computer for controlling the air, fuel and electricity supply to the engine, is thus cooled.

As a variant, the unit 15 and the air filter 14 are secured to the built-in pipework 1 and carried, for example, by the casing 3, into which they are built as a prewired sub-assembly making it possible, before mounting on engine, to carry out trials, checks, and compensation settings, and facilitating the mounting on engine, thereby allowing improvements in quality and savings in terms of costs.

The built-in pipework 1 also includes a rail 16 for distributing fuel to the injectors of the "top feed injector" type. This rail 16 is built into the casing 3 and extends along the latter, on the side turned towards the flange 6. The ends of the rail 16 are equipped with tubular fittings 17 and 18 which are coupled, one to a supply pipe from the fuel tank, through the use of a pump and a filter, and the other to a pipe returning the excess fuel to tank. This excess is determined by a fuel pressure regulator 19 which is supported by the casing 3 and in communication, on the one hand, with the inside of the rail 16 and, on the other hand, with the inside of the casing 3, so as to be in equilibrium between the pressure of the fuel in the rail 16 and the pressure of the intake air in the module 2. Between the ends of this rail 16, and for each injector, the casing 3 has an orifice for supplying the corresponding injector via its top, which is in communication with the inside of the rail 16.

The injectors, not represented in FIG. 1, are each trapped between the casing 3 and the base element 4, so as to be supplied, each one via its top and via the corresponding orifice for communicating with the supply rail 16, and so that they emerge, each via its opposite end and via a suitable orifice, in the corresponding branch 5.

The electric ignition circuit of the engine comprises one or more high tension coils 20 and 21, which are mounted in housings formed in the upper part of the casing 3, and which are connected to the spark plugs of the engine by a bundle of conducting cables 22.

The electrical supply to the coils 20 and 21, and to the pressure and temperature sensors 11 and 12 as well as, if appropriate, to the stepper motor 9 and to the potentiometer 10, the transmission to some of these components of electrical control signals coming from the electronic control unit 15, and the return of electrical signals coming from the sensors 11 and 12 as well as from the potentiometer 10 towards the electronic control unit 15 are provided with the aid of two electrical connectors 23 and 24, one of which is a low-power connector and the other a high-power connector. These connectors 23 and 24 are built into the casing 3, on the side of the latter opposite the flange 6. Each of the connectors 23 and 24 is mounted in a sealed manner in its corresponding housing on the casing 3, for example by overmoulding the latter, with plastic, around the corresponding connector.

Thus, all the components which are built in and/or carried in and/or on the casing 3 of the distributor/-manifold module 2 may easily be coupled to the electrical circuits of the engine and of the vehicle using the connectors 23 and 24, the high-power connector 24 being coupled to the power components such as the coils 20 and 21, whereas the low-power connector 23 is coupled to the sensors such as 11 and 12 and to the injectors. For each of the components incorporated in or on the built-in pipework 1, and which require an electrical earth return, this coupling to earth is produced by virtue of a bundle of electrical conducting wires which is built into the plastic casing 3.

In the embodiment of FIGS. 2 to 7, it is again seen that the built-in pipework 31 comprises an air distributor/manifold module 32 consisting of the assembly of two moulded plastic or metallic components used without further machining, one of which is a casing 33 and one a base element 34. The base element 34 includes four pipework branches 35 which are secured, via their downstream end, to the flange 36 for fixing on to the cylinder head of the engine, this flange 36 being subdivided into two plates 36*a* and 36*b*, each of which carries, in projection on the same side as the branches 35, sockets 37 in which the bore passes through the corresponding plate 36*a* or 36*b* for the passage of the screws for fixing on to the cylinder head (not represented). Each branch 35 comprises two parts, namely a downstream part 35*a*, which is cylindrical and of circular cross-section, via which the branch 35 is secured to the corresponding flange part 36*a* or 36*b*, and an upstream part 35*b*, which is curved and has concavity turned towards the corresponding flange part 36*a* or 36*b*. Via the upstream end of its curved part 35*b*, each branch 35 is secured to a flange 38 of the base element, pierced with holes 39 for the passage of screws for fixing on the base element 34 on to the casing 33. Thus, each branch 35 emerges via an inlet opening 40 in the flange 38 for connecting to the casing 33 and via an outlet opening 41 in the flange part 36*a* or 36*b* for fixing on to the cylinder head. At the junction of each downstream branch part 35*a* to the corresponding flange part 36*a* or 36*b*, the latter has a through piercing 42 which emerges both in the face of the flange part 36*a* or 36*b* located on the side opposite the corresponding branch 35, and in the outlet opening 41 of this branch 35. In the face of the flange part 36*a* or 36*b* which is turned towards the corresponding branch 35, this piercing 42 is surrounded by an annular support seat 43 for an injector, and this seat 43 is itself partially surrounded, towards the corresponding branch 35, by a cup 44 which, together with the piercing 42 and the seat 43, delimits a housing for the tip of an injector of the type in which fuel is fed from the top, at the end opposite the tip. The flange part 36*a* also has, on its face turned towards the flange 38 for joining to the casing 33, a dish 45 for housing a part of the fuel pressure regulator, the structure of the dish 45 as well as its interaction with the regulator and with the casing 33 being described hereinbelow with reference to FIG. 7.

The casing 33 includes an elongate part of substantially prismatic 46 or cylindrical shape, which delimits an internal chamber termed a plenum chamber, which is open to the outside via an air inlet orifice formed in the end face of the part 46 which is not visible in the figures. As in the example of FIG. 1, a butterfly body, to which is secured a sensor of the angular position of the butterfly as well as an actuator for setting the idle air flow or for controlling the butterfly, may be coupled in a sealed manner to the inlet orifice of the casing 33.

This casing 33 includes, on the side opposite the flange 36 when it is fixed to the base element 34, air outlet pipes 47 (FIG. 4) equal in number to the branches 35, and each one of which emerges via its upstream end in the plenum chamber 46 and via its downstream end in a flange 48 of the casing 33, which has a shape conjugate to that of the flange 38 of the base element 34, and is also pierced with holes 49 for the passage of screws for fixing the two flanges 38 and 48 against one another with interposition of a sealing gasket, for fixing the casing 33 to the base element 34, as represented in FIGS. 5 and 6. The air pipes 47 are also curved and have their concavity turned towards the flange 36, and each one emerges in the flange 48 via an air outlet opening, directly opposite the air inlet opening 40 of the corresponding branch 35 and of the same shape, so that this branch 35 and this pipe 47 are in the continuation of one another and partially surround the plenum chamber 46 and the various components trapped between the casing 33 and the base element 34 and housed in and/or on the casing 33, as described hereinbelow, in a configuration of reduced size which still provides a good air supply to the engine.

On the side of the flange 36, the casing 33 has, over its entire length, a built-in fuel distribution rail 50, supplied from the tank via an inlet fitting 51 at one end, and coupled to a return-to-tank by an outlet fitting 52 at the other end. Substantially between the fittings 51 and 52, the casing 33 also has, for housing the injectors, four evenly-spaced parallel cylindrical sleeves 53 projecting sideways towards the flange 36, the bottom of each one of which communicates with the inside of the rail 50 via at least one orifice for supplying the corresponding injector with fuel.

Each of the four injectors 54 is of the type termed "top feed injector", with a tip surrounded by an O-ring seal which is housed in a sealed manner in the corresponding housing (42-43-44) of the flange 36*a* or 36*b* for fixing on to the cylinder head, whereas its rear part or top, also surrounded by an O-ring seal, is housed in a sealed manner in the corresponding sleeve 53 so as to be supplied with fuel via the rail 50, parallel with the other injectors 54, this central part of the injector 54 having a connector 54*a* for the electrical supply to a coil for actuating the injector 54, this connector 54*a* projecting between the corresponding sleeve 53 and the corresponding cup 44 when, for each cylinder, the corresponding injector 54 is trapped between the casing 33 and the base element 34 which are fixed to one another.

The casing 33 also has, projecting sideways and directly opposite the dish 45, a cylindrical sleeve 55, in communication with the rail 50, for housing a part of the device 56 for regulating the pressure of the fuel supplied to the injectors, and another part of which is housed in the dish 45, when the casing 33 and the base element 34 are fixed to one another, so that the regulator 56, trapped between casing 33 and base element 34 is then in equilibrium between the pressure of fuel in the rail 50 and the air intake pressure in the plenum chamber 46. This is obtained in the manner represented in FIG. 7. In the position of interaction of the dish 45 and of the sleeve 55, when the casing 33 and the base element 34 are fixed to one another, the edge 57 of the dish 45 is fitted in a sealed manner by virtue of the O-ring seal 58 around the sleeve 55 which has, as a direct result of moulding, a passage 59 emerging in the plenum chamber 46. Pads 60, just one of which is represented in FIG. 7, which project into the bottom of the dish 45 keep a part 56*a* of the regulator 56 engaged in the dish 45 with radial and axial clearance, and the bottom of this regulator part 56*a* is pierced at 61, so that the pressure of the air in the plenum chamber 46 is taken in via the passage 59 and the inside of the dish 45, into the regulator 56 on one face of an internal membrane (not represented) which is also urged by a spring. The part 56*b* of the regulator 56, on the other side of a collar 56*c* of the regulator in abutment against the sleeve 55, is fitted in a sealed manner via the O-ring seal 62 into a recess in the sleeve 55 and extends via a tip 56*d* also mounted in a sealed manner via an O-ring seal 63 in an internal passage 64 of the sleeve 55 and emerging into the passage 50*a* in communication with the return-to-tank, and the tip 56*d* of the regulator opens into this passage 64 so that the other face of the internal membrane of the regulator 56 receives the pressure of the fuel in the rail 50.

As represented in FIGS. 2 and 4, the casing 33 also has, on the side turned towards the flange 36, and close to the sleeve 55, a platform 65 supported above a housing 66. A pressure sensor 67 is mounted on the platform 65 (see FIGS. 5 and 6) and its probe passes, in a sealed manner, through the platform 65 so as to be sensitive to the pressure of the intake air in the plenum chamber 46. The housing 66 of the casing 33 also receives sensors or members for controlling operating parameters of the engine, and in particular a sensor for the temperature of the intake air in the plenum chamber 46. In addition to the sensors of intake air circulation parameters, the housing 66 may also contain ignition coils which, together with the other sensors or control members housed or carried by the casing 33, may be connected, as in the example of FIG. 1, to a low-power connector and to a high-power connector (not represented) which are mounted in a sealed manner in housings, for example, in the face of the casing 33 which cannot be seen in the figures. As in the built-in pipework of FIG. 1, a bundle of electrical conducting wires may also be built into the plastic casing 33 to provide the coupling to electrical earth of all the components which are built into the pipework.

By comparison with the example of FIG. 1, the built-in pipework 31 of FIGS. 2 to 7 has a smaller size, owing to the fact that its shape is substantially closed in on itself resulting from the fact that the casing 33 and the components which it carries are partially enveloped by the curved parts of the pipework branches 35 and air pipes 47. The overhang of the built-in pipework 31 fixed to the cylinder head of the engine is reduced, in proportion as the distance between the flange 36 for fixing on to the cylinder head and the centre of gravity of the built-in pipework 31 is less than the distance between this flange 36 and the geometric centre of the pipework 31, owing to the fact that the majority of the components built into the pipework 31 are mounted on that part of the casing 33 which is located on the side of the flange 36, and also by virtue of the presence of the injectors 54 and of the pressure regulator 55 which are trapped between the casing 33 and the flange 36 of the base element 34. As a result, this integrated pipework which is fixed to the cylinder head of the engine has better mechanical behaviour with a reduced overhang.

Figure 8:
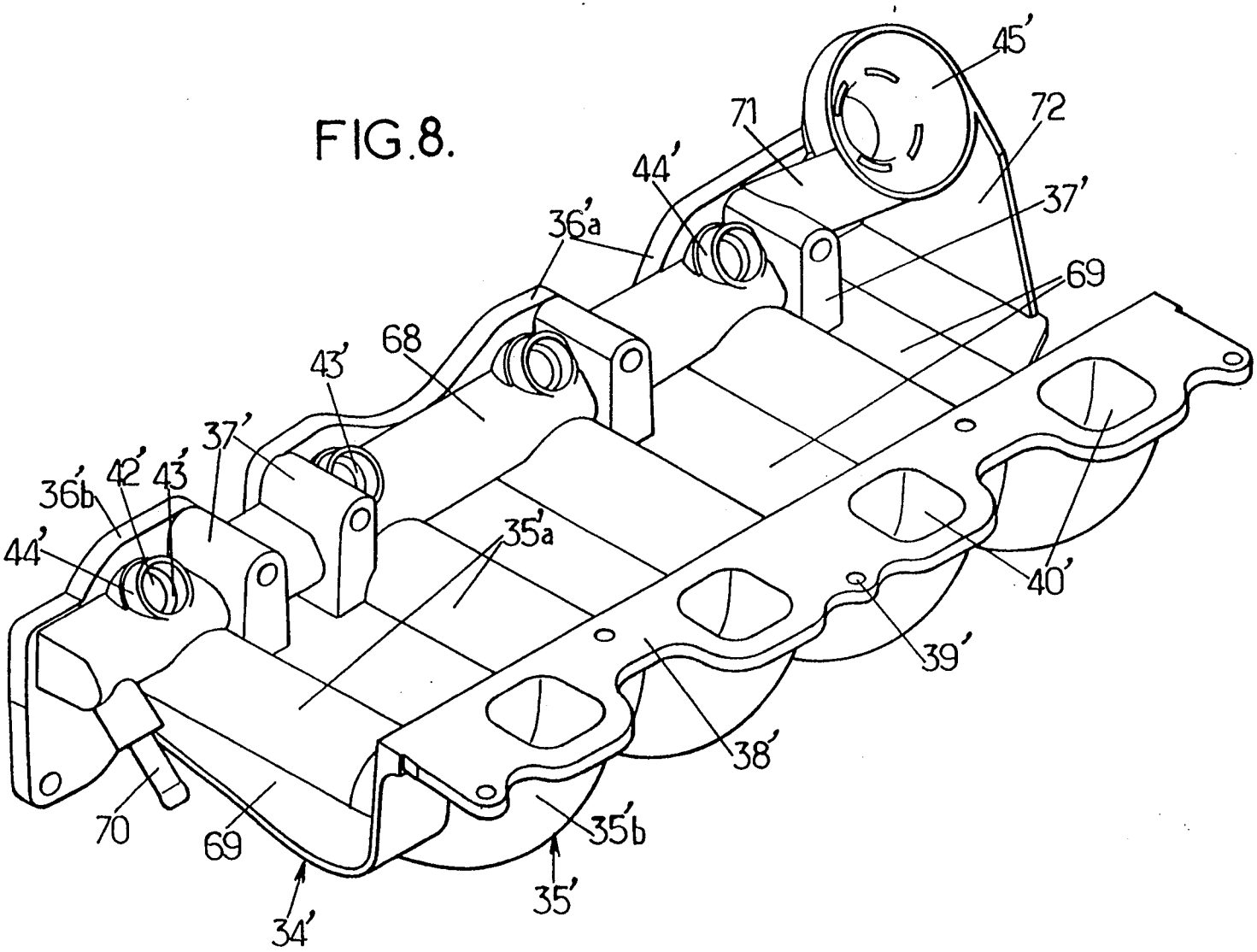
Figure 9:
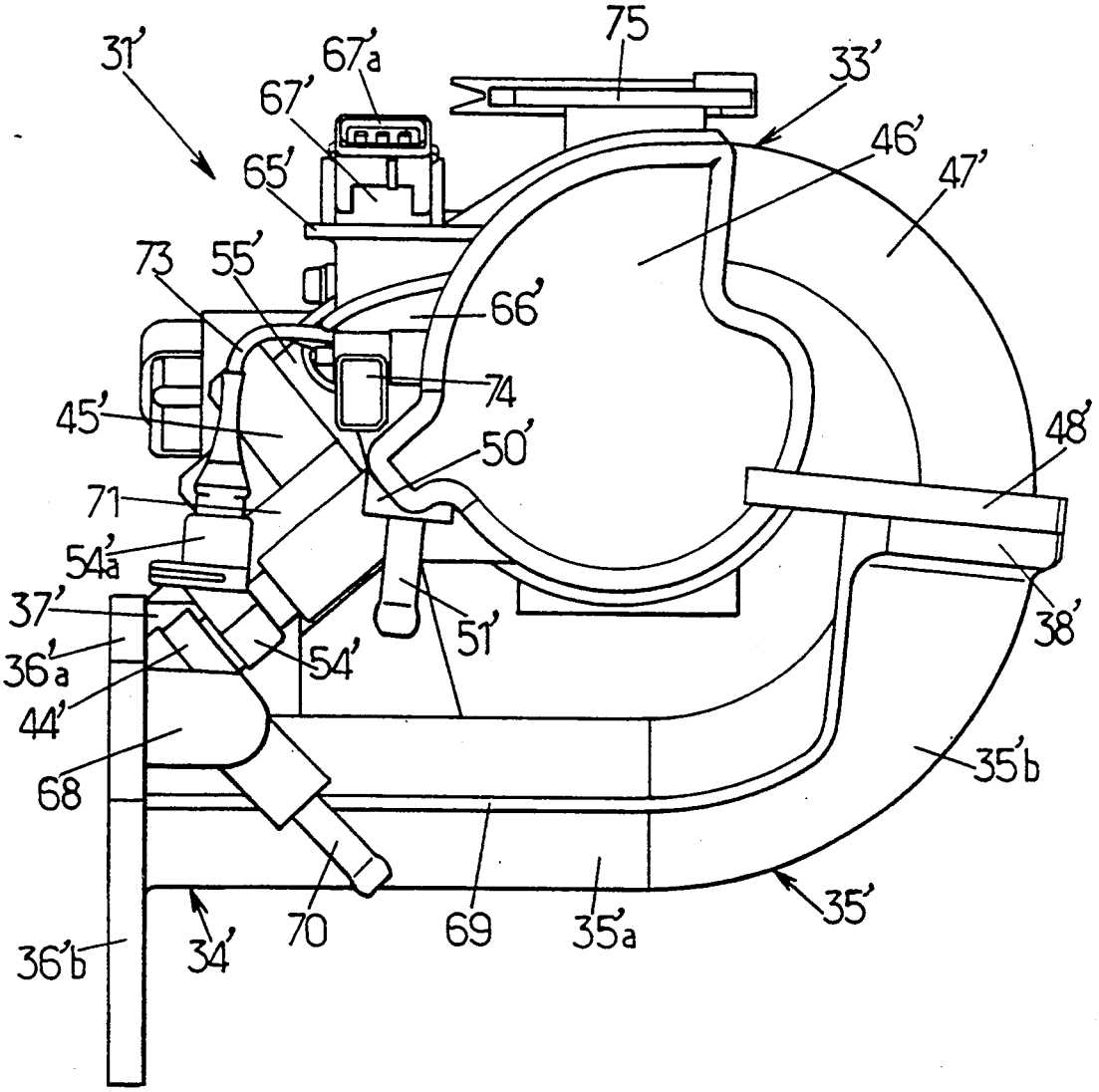

FIGS. 8 and 9 represent a variant of the pipework of FIGS. 2 to 7, which is designed to receive ventilated injectors. For this reason, the elements of the pipework of FIGS. 8 and 9 which are similar to those of the embodiment of FIGS. 2 to 7 are identified by the same numerical references as in FIGS. 2 to 7 but have been assigned a prime symbol, and are not described again, except when they exhibit significant differences.

The built-in pipework 31' of FIGS. 8 and 9 is essentially differentiated from that of FIGS. 2 to 7 by the structure of its base element 34' (see FIG. 8) into which is built an additional air supply line 68. This line 68 extends along the flange parts 36'*a* and 36'*b* for fixing on to the cylinder head, on the side of the pipework branches 35'*a*–35'*b* rigidly joined to one another by a central web 69 secured to the flange 38' of the base element 35'. The air line 68 is made as a single piece with the flange parts 36'*a* and 36'*b* and with the branches 35', perpendicularly to the latter, in the corner formed at the junction between these elements. The air line 68 has parts 37' which project and have a greater thickness and are pierced with holes for the passage of screws for fixing the pipework 31' on to the cylinder head, and corresponding to the sockets 37 of the example of FIGS. 2 to 7. At one end, the air line 68 has, projecting from the side of the branches 35', a tubular fitting 70 for coupling to an additional air inlet pipe, the additional air being taken at atmospheric pressure from the air filter cap (not represented), downstream of the actual filter. The other end of the air line 68 is closed at a projecting part 37' which supports, via an arm 71, the dish 45' for housing the fuel pressure regulator, this dish 45' also being supported by the flange part 36'*a* and by an end wall 72, the base of which is coupled to the central web 69.

At each branch 35' the air line 68 has, projecting from its upper face, a cup 44' for housing the tip of an aerated injector 54', the cup 44' simultaneously projecting sideways from the flange part 36'*a* or 36'*b* on the side turned towards the casing 33' and open towards the sleeve 53' projecting from the casing 33' and in communication with the fuel distribution rail 50', which is built into the casing 33' and supplied with fuel via the fitting 51'. The cup 44' has an internal annular seat 43' for supporting the tip of the injector 54', and is extended by a through piercing 42' formed partly in the air line 68 and partly in the flange part 36'*a* or 36'*b*, to emerge in the downstream end of the pipework branch 35'. The cup 44' delimits, together with the seat 43' and the corresponding piercing 42', a housing which communicates via a side orifice with the inside of the air line 68, so that the tip of the corresponding aerated injector 54', which is arranged in this housing 44'–42', is thus supplied with additional air, whilst the rear or top part of the injector 54', which is housed in the corresponding sleeve 53' is supplied with fuel in this sleeve from the fuel rail 50' of the casing 33'. The air line 68 thus makes it possible to supply each of the aerated injectors 54' with additional air at its tip, whereas the fuel supply to each injector 54' is provided as in the preceding example.

In FIG. 9, the air outlet pipes 47' from the casing 33' are again found, these pipes connecting the plenum chamber 46' to the pipework branches 35' as well as, on the other side of the plenum chamber 46', the platform 65' carrying the pressure sensor 67' with its electrical connector 67'*a*, as well as the side housing 66' of the casing 33' under the platform 65' and the sleeve 55' projecting from the housing 33' opposite the dish 45' for housing the device for regulating the pressure of the fuel, and the electrical connector 54'*a* for each injector 54' is coupled via a conductor 73 of an electrical bundle to an electrical connector 74 built into the casing 33' for electrically supplying the coils for actuating the injectors 54'. Finally, in FIG. 9, above the casing 33', is the cam 75 which is actuated by cable, in order to drive the butterfly rotationally in the body mounted on the air inlet to the plenum chamber 46', at the end of the casing 33' which is not visible in FIG. 9.

In this variant also, the air filter and the computer for controlling the supply to the engine may be built into the built-in pipework 31' and combined with the latter as a pre-wired sub-assembly which is tested, checked and set before being mounted on the engine.

I claim:

1. Supply device with built-in pipework for a system supplying an internal combustion engine with fuel by injection of the multipoint type, comprising an air intake distributor/manifold module including two moulded components fixed to one another, and one of which is a pipework casing having an air supply orifice, on which is arranged a butterfly body, and air outlet openings, formed in a flange for Joining to the other component, which is a base element having at least as many pipework branches as the engine has cylinders, and-a flange for joining to the casing, which flange is fixed to the flange of the casing with interposition of a sealing gasket, and in which each branch opens out at one of its ends via an inlet opening, corresponding to one, respectively, of the outlet openings from the casing, to emerge in the latter, the pipework branches being secured via their other end to at least one fixing flange of the base element, which flange is equipped with means for fixing the built-in pipework on to the cylinder head of the engine, the pipework casing being designed so that it supports and/or encloses, at least partially, at least one sensor and/or at least one member for controlling an operating parameter of the engine and, for each cylinder of the engine, each corresponding injector being arranged between the casing and the base element of the module, wherein a fuel distribution rail is built into the casing which has, at each of the two ends of the rail, a tubular fitting for coupling the rail to a fuel supply pipe from a tank and to a pipe for returning the fuel to tank respectively, the casing having, between the two ends of the rail, and for each injector, at least one orifice in communication with the inside of the rail, for supplying the corresponding injector with fuel.

2. Supply device according to claim 1, wherein each fuel supply to an injector is provided in a sleeve, projecting from the casing, on the side turned towards at least one flange for fixing on to the cylinder head, and in which the corresponding injector is at least partially housed with a sealing gasket.

3. Supply device according to claim 1, wherein, for each injector, a flange for fixing the base element on to the cylinder head has, on the side turned towards the casing, a housing for receiving an injector, emerging in the corresponding pipework branch and in which the corresponding injector is at least partially housed with a sealing gasket.

4. Supply device according to claim 1, wherein an additional air supply line is built into the base element, substantially at the junction of the pipework branches and of a flange for fixing the base element on to the cylinder head and has, at one of its ends, a tubular coupling fitting for the supply of additional air taken from an air filter, downstream of the actual filter and, for each injector, at least one orifice placing the inside of the additional air supply line in communication with the inside of a housing for receiving the injector, formed in the flange and/or the additional air supply line on the side turned towards the casing, and emerging in the corresponding pipework branch, so as to house, at least partially, an injector of the ventilated type which is supplied with fuel and with air simultaneously.

5. Supply device according to claim 1, wherein a device for regulating the pressure of the fuel supplied to the injectors is trapped between the casing and the base element of the module.

6. Supply device according to claim 5, wherein at least one flange for fixing the base element on to the cylinder head has, on the side turned towards the casing, a dish for receiving the pressure regulator, interacting with a sleeve for housing the said regulator, projecting from the casing, on the side turned towards the said fixing flange and in communication with the fuel rail so that, when the regulator is housed in the sleeve and in the dish, and when the base element is fixed on to the casing, the regulator is in equilibrium between, on the one hand, the fuel pressure in the rail, which it receives via a regulator part which is engaged in a sealed manner in the said sleeve and, on the other hand, the pressure of the air in the module, which it receives via a regulator part which is engaged in the said dish, the inside of which is connected in a sealed manner, in the interaction position of the sleeve and of the dish, with a passage formed in the said sleeve and emerging in the casing.

7. Supply device according to claim 1, wherein the casing has at least one electrical connector, mounted in a sealed manner in a corresponding housing of the casing, and providing the connection with at least one component carried in and/or on the module, such as an ignition coil.

8. Supply device according to claim 1, wherein housings are formed in and/or in the casing which receive at least sensors of intake air circulation parameters, such as sensors for measuring the temperature and pressure of the air in the module, at least one power component such as an ignition coil, at least one low-power electrical connector, connected at least to the said sensors and to the injectors, and at least one high-power electrical connector, connected at least to the said power component.

9. Supply device according to claim 8, wherein there is comprised at least one bundle of electrical conductors, preferably built into the casing, providing the coupling to electrical earth of each component built into and/or on to the said module.

10. Supply device according to claim 1, wherein at least some of the components built into the pipework are mounted in and/or on a part of the module which is located on the side of the flange or flanges for fixing on to the cylinder head, and that the casing and the base element of the module have a configuration such that the distance separating the centre of gravity of the built-in pipework from the plane for fixing the flange or flanges on to the cylinder head is less than the distance separating the geometric centre of the said built-in pipework from this plane for fixing the flange or flanges on to the cylinder head.

11. Supply device according to claim 10, wherein, on the side opposite at least one flange for fixing on to the cylinder head, the casing has air outlet pipes, equal in number to the number of branches of pipework coupled to the said fixing flange, each one emerging via one end in a central chamber of the casing called a plenum chamber, and via the other end in the flange of the casing fixed to the flange of the base element, level with an outlet opening corresponding with a pipework branch, so that each pipework branch which is curved in at least an upstream part coupled to the flange of the base element fixed to the casing, extends a corresponding air pipe of the casing, which is also curved, the curved air pipes and the curved parts of the pipework branches having their concavity turned towards the said flange for fixing on to the cylinder head, so as to envelope partially the plenum chamber and the various components which are trapped between the casing and the base element and/or housed in/or on the casing.

12. Supply device according to claim 1, wherein an air filter is built into the air intake distributor/manifold module.

13. Supply device according to claim 1, wherein a computer for controlling the supply to the engine is built into the air intake distributor/manifold module.

14. Supply device according to claim 13, wherein an air filter and the computer for controlling the supply to the engine are built into the distributor/manifold module and combined with the latter as a pre-wired sub-assembly.

* * * * *